US005305877A

United States Patent [19]

Olsen

[11] Patent Number: 5,305,877

[45] Date of Patent: Apr. 26, 1994

[54] CARRIER STOCK WITH OUTER BAND SEGMENTS HAVING CONCAVE EDGE PORTIONS

[75] Inventor: Robert Olsen, Medinah, Ill.

[73] Assignee: Illinois Tool Works Inc., Glenview, Ill.

[21] Appl. No.: 50,848

[22] Filed: Apr. 21, 1993

[51] Int. Cl.[5] ..... B65D 75/62

[52] U.S. Cl. ..... 206/150; 206/151; 294/87.2

[58] Field of Search ..... 206/150, 151, 158, 160, 206/428; 294/87.2, 87.28

[56] References Cited

U.S. PATENT DOCUMENTS

| | | | |
|---|---|---|---|
| 3,383,827 | 5/1968 | Schaich | 206/158 |
| 4,064,989 | 12/1977 | Olsen | 206/151 |
| 4,109,787 | 8/1978 | Klygis et al. | 294/87.2 |
| 4,401,211 | 8/1983 | Pillman et al. | 206/150 |
| 4,592,466 | 6/1986 | Walters et al. | 206/150 |
| 4,624,363 | 11/1986 | Edwards | 206/150 |
| 5,020,661 | 6/1991 | Marco | 206/150 |
| 5,209,346 | 5/1993 | Pratt et al. | 206/150 |

*Primary Examiner*—David T. Fidei

*Attorney, Agent, or Firm*—Dressler, Goldsmith, Shore & Milnamow, Ltd.

[57] ABSTRACT

Carrier stock for machine application to substantially identical cans of a newer type having an end with a chime of a relatively small diameter, a cylindrical side wall of a relatively large diameter, and a generally frusto-conical wall between the cylindrical wall and the chime is formed from a single sheet of resilient polymeric material and has integrally joined band segments defining can-receiving apertures. These include generally longitudinal outer segments, each having inner and outer edges associated with one such aperture. When the stock is unstressed, two lateral portions of the inner edge are concave, two lateral portions of the outer edge are convex, and a central portion of the outer edge is concave. A central region between the lateral portions may have an integrally joined tear-open tab. Certain generally transverse segments, which join inner segments, may have curved edges when the stock is unstressed.

10 Claims, 3 Drawing Sheets

CARRIER STOCK WITH OUTER BAND SEGMENTS HAVING CONCAVE EDGE PORTIONS

TECHNICAL FIELD OF THE INVENTION

This invention pertains to carrier stock for machine application to substantially identical cans, such as beverage cans having annular chimes, cylindrical side walls, and frusto-conical walls between the chimes and the side walls. This invention provides carrier stock in a unique configuration that can be effectively applied to cans of a newer type, with which it has been difficult to use carrier stock as known heretofore because the frusto-conical walls adjacent the lids of the cans of the newer type define severe, conical angles relative to can axes.

BACKGROUND OF THE INVENTION

Carrier stock as exemplified in Weaver et al. U.S. Pat. No. 4,219,117 is employed commonly for machine application, typically with machines described in Braun U.S. Pat. No. 4,250,682 or other similar jaw and drum machines, to substantially identical cans, such as beverage cans utilized commonly to contain beer and soft drinks. Such cans have annular chimes at their upper ends, cylindrical side walls, and frusto-conical walls between the chimes and the side walls. Such stock is formed, as by die-cutting, from a single sheet of resilient polymeric material, such as low density polyethylene.

Such stock has integrally joined band segments defining can-receiving apertures in longitudinal rows and transverse ranks. The band segments include generally longitudinal outer segments with each outer segment partly bounding the can-receiving apertures in an outer row.

In the carrier stock illustrated and described in the aforenoted patent, the band segments also include inner segments partly bounding the can-receiving apertures, along with transversely extending segments joining the inner segments. When such stock is applied effectively, the band segments defining the can-receiving apertures grip the frusto-conical walls of the cans tightly and engage the lower edges of the chimes.

Can manufacturers have in the past introduced cans having smaller chime diameters, as compared to the diameters of the side walls. Cans of this type are known as "necked-in" cans. The newest version of these necked-in cans further and drastically reduces the ratio of the chime diameter and the side wall diameter.

In a necked-in can of a newer type, the frusto-conical wall between the chime and the side wall defines a conical angle greater than approximately 28°, and in some instances as great as approximately 37°. When the frusto-conical wall defines such a large angle relative to the can axis, it is difficult to apply carrier stock as exemplified in the aforenoted Weaver et al. patent effectively, since the band segments defining the can-receiving apertures have an undesirable tendency to slide up the cans and to rest on the cans above the lower edges of the chimes. This tendency is enhanced due to the jaw application system mentioned above.

Thus, there is a need, to which this invention is addressed, for carrier stock that can be effectively applied to cans of the newer, further necked-in type.

SUMMARY OF THE INVENTION

This invention provides carrier stock in a unique configuration for machine application to substantially identical cans of a type having an end with a chime of a given diameter, a cylindrical side wall of a larger diameter, and a generally frusto-conical wall between the chime and the cylindrical side wall. Generally, such stock can be effectively applied to cans of the newer type discussed above.

The carrier stock is formed, as by die-cutting, from a single sheet of resilient polymeric material, such as low density polyethylene. As formed, such stock has integrally joined band segments defining can-receiving apertures in longitudinal rows including two outer rows and in transverse ranks, usually in a rectangular array. While the proposed embodiments show carrier stock with two rows of such apertures, the carrier stock could be also used on carrier stock with three or more rows of such apertures.

The band segments include outer segments extending longitudinally. Each outer segment partly bounds one of the can-receiving apertures. Each outer segment has a central region. Each outer segment also has an inner edge with two lateral portions adjacent the central portion where such outer segment partly bounds one of the can-receiving apertures. In the unique configuration provided by this invention, the lateral portions of the inner edge are concave when such stock is in a flat, unstressed condition.

Each outer segment has an outer edge with a central portion along the central region of such outer segment and with two lateral portions adjacent the central portion. In the unique configuration provided by this invention, the lateral portions of the outer edge are convex when the carrier stock is in a flat, unstressed condition. Preferably, moreover, the central portion of the outer edge is concave when such stock is in a flat, unstressed condition. Furthermore, it is preferred that each outer segment has a substantially uniform width along the lateral portions of its inner and outer edges when such stock is in a flat, unstressed condition.

In a preferred configuration of the carrier stock provided by this invention, each outer segment has a tear-open tab, which is joined integrally to its central region. Desirably, the tear-open tabs extend into the can-receiving apertures when such stock is in a flat, unstressed condition. Thus, each tear-open tab has two parallel, lateral edges, each of which merges with one of the lateral portions of the inner edge of the outer segment having such tear-open tab via a curved transition to avoid stress concentration. In a particularly preferred configuration, each lateral edge defines an obtuse angle with its adjacent lateral portion of the inner edge of the outer segment having such tear-open tab when such stock is in a flat, unstressed condition.

In an alternate configuration of the carrier stock provided by this invention, tear-open tabs are not provided. However, the central region of each outer segment has an inner edge, which is convex when such stock is in a flat, unstressed condition.

Additionally, the integrally joined band segments may include generally transverse inner segments defining inner edges of the can-receiving apertures and generally transverse segments joining the inner aperture-defining segments. In the unique configuration provided by this invention, the generally transverse segments may include some having curved edges when such stock is in a flat, unstressed condition.

In one contemplated configuration, the generally transverse segments include pairs of such segments having substantially uniform widths and curved edges when the carrier stock is in a flat, unstressed condition. In another contemplated configuration, the generally transverse segments include pairs of such segments having substantially uniform widths and curved edges when the carrier stock is in a flat, unstressed condition. Another configuration contemplates the transverse segments as being a solid web.

These and other objects, features, and advantages of this invention are evident from the following description of a preferred embodiment of this invention with reference to the accompanying drawings.

DETAILED DESCRIPTION OF ILLUSTRATED EMBODIMENTS

Figure 1:
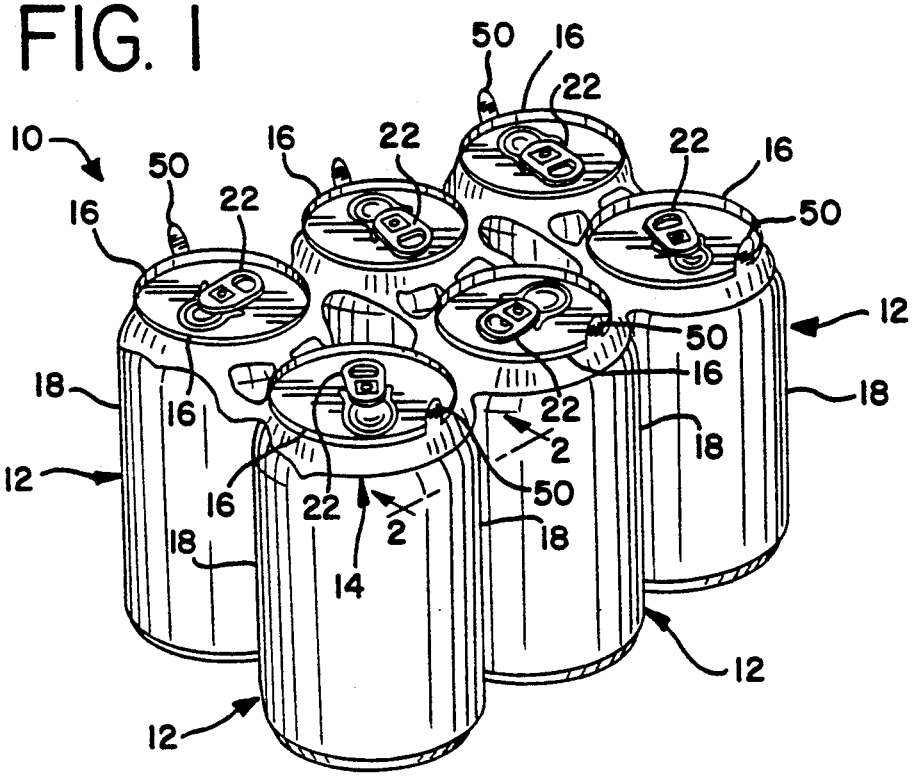
FIG. 1 is a perspective view of a package comprising six substantially identical cans of the newer type discussed above and a carrier severed from a carrier stock according to a generally preferred embodiment contemplated by this invention.
Figure 2A:
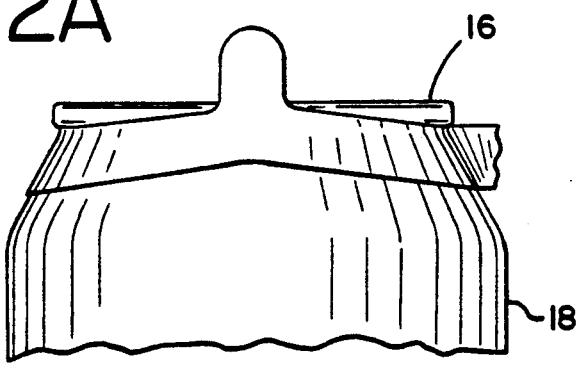
FIG. 2A is a similar view of a prior art carrier stock on a can of the newer type.
Figure 2:
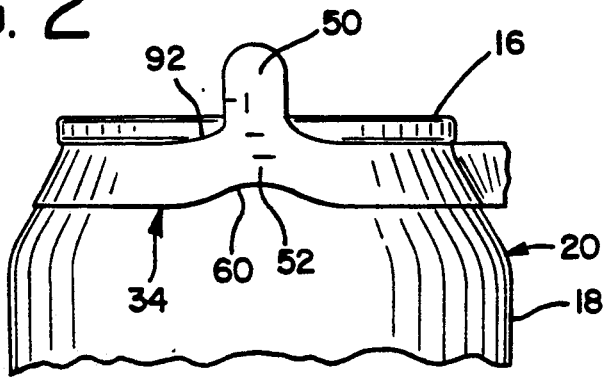
FIG. 2, on a larger scale, is a fragmentary, sectional view taken along line 2—2 of FIG. 1, in a direction indicated by arrows.

As shown in FIG. 1, a package 10 comprises six substantially identical cans 12 of the newer type noted above, and a carrier 14, which is severed from a carrier stock embodying this invention. As shown in FIGS. 1 and 2, each can 12 has an annular chime 16 of a given diameter at its upper end, a cylindrical side wall 18, and a frusto-conical wall 20 of a larger diameter between the annular chime 16 and the cylindrical side wall 18. The annular chime 16, the cylindrical side wall 18, and the frusto-conical wall 20 define a can axis. As shown in FIG. 1, the upper end of each can 12 has a pull tab 22.

Generally, since each can 12 is of the newer type noted above, the frusto-conical wall 20 of such can 12 may define a conical angle greater than 28° relative to the can axis.

Figure 3:
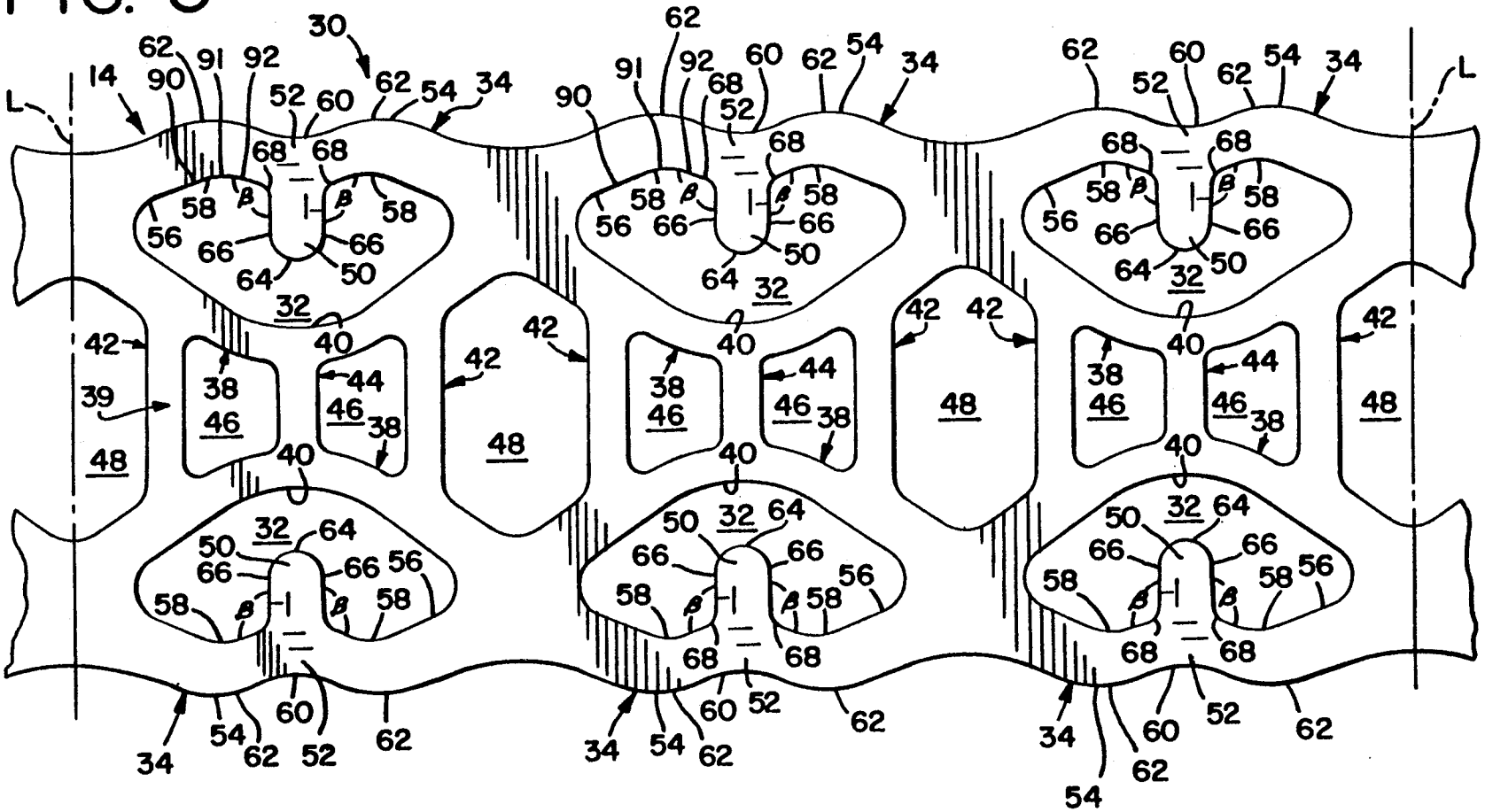
FIG. 3 is a fragmentary, plan view of carrier stock according to the generally preferred embodiment noted above, in a flat, unstressed condition.

As shown in FIG. 3, a carrier stock 30 constituting a generally preferred embodiment contemplated by this invention is formed in an indeterminate length, as by die-cutting, from a single sheet of resilient polymeric material. A preferred material is low density polyethylene. A preferred thickness for such stock 30 in an unstressed condition, if low density polyethylene is used, is in a range from approximately 16 mils to approximately 17.5 mils. The carrier stock 30 is severable along transverse lines L to form individual carriers exemplified by the carrier 14. The lines L may be preslitted or prescored to facilitate severing the carrier stock 30.

The carrier stock 30 is formed, for each individual carrier 14, with integrally joined band segments defining six can-receiving apertures 32 in a rectangular array with two longitudinal rows and with three transverse ranks. The band segments include outer segments 34 extending longitudinally, in two longitudinal rows, with each outer segment 34 partly bounding one of the can-receiving apertures 32.

The band segments also include inner segments 38 extending longitudinally, in two longitudinal rows, with each inner segment 38 partly bounding one of the can-receiving apertures 32. The band segments also include a transverse web section 39 or clusters of generally transverse segments joining the inner segments 38 in one such row to the inner segments 38 in the other row. The inner segments 38 have edges 40 along the can-receiving apertures 32.

The longitudinally outermost regions of each cluster include two generally transverse segments 42 joining the inner segments 38 defining the inner edges 40 of the can-receiving apertures 32 in a respective one of the transverse ranks, near the longitudinal ends of the same inner segments 38, and one generally transverse segment 44 joining the same inner segments 38, between the generally transverse segments 42 of such cluster.

The generally transverse segments 42, 44, and the inner segments 38 define two additional apertures 46 within each cluster and one additional aperture 48 between each cluster and the next cluster in either direction along the carrier stock 30. A user may carry the package 10 described above, via the thumb and forefinger of one hand grasping the outer edges of the segments 42 of a selected cluster, within such apertures 46.

A tear-open tab 50 is joined integrally to a central region 52 of each outer segment 34, so as to extend transversely into the can-receiving aperture 32 partly bounded by such outer segment 34 when the carrier stock 30 is in a flat, unstressed condition. Each tear-open tab 50 and the central region 52 of the outer segment 34 having such tear-open tab 50 are slitted, as shown, so that the outer segment 34 having such tear-open tab 50 can be easily torn through the central region 52 thereof to release a can, such as one of the cans 12, from the can-receiving aperture 32 partly bounded thereby. Preferably, each tear-open tab 50 is similar to the tear-open tabs illustrated and described in Marco U.S. Pat. No. 5,020,661, the disclosure of which is incorporated herein by reference.

Each outer segment 34 has an outer edge 54 and an inner edge 56, which has two lateral portions 58 adjacent to the central region 52 of such outer segment 34, one on each side of the tear-open tab 50 joined integrally thereto. The outer edge 54 of each outer segment 34 has a central portion 60 along the central region 52 of such outer segment 34 and which has two lateral portions 62 adjacent to the central portion 60, one on each side of the central portion 60. Also, each outer segment 34 has a substantially uniform width along the lateral portions of its outer and inner edges when the carrier stock 30 is in a flat, unstressed condition. The slight taper of each outer segment 34 toward the central portion 60 is considered substantially uniform within the spirit of this invention.

As shown in FIG. 3, the lateral portions 58 of the inner edge 56 of each outer segment 34 are concave when the carrier stock 30 is in a flat, unstressed condition, and each such portion 58 includes three regions 90, 91, 92. Also, the central portion 60 of the outer edge 54 of each outer segment 34 is concave and the lateral portions 62 of the outer edge 54 of such outer segment 34 are convex when the carrier stock 30 is in a flat, unstressed condition.

Each tear-open tab 50 has a curved, distal edge 64 and two parallel, lateral edges 66, each of which defines an obtuse angle $\beta$ (see FIG. 3) with the region 92 of the adjacent lateral portion 58 of the inner edge 56 of the outer segment 34 with such tear-open tab 50 and merges therewith, via a curved transition 68 having a small radius (e.g., a radius of 0.070 inch) to avoid stress concentration. An angle $\beta$ of approximately 110° is preferred.

Figure 4:
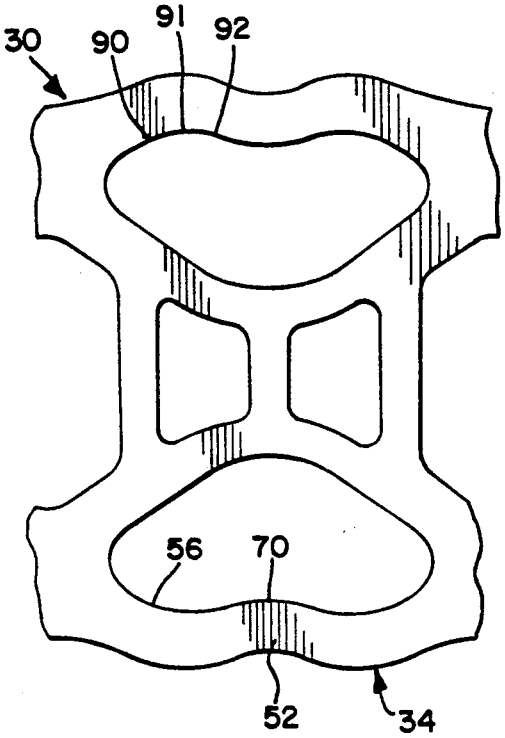
FIGS. 4, 5, 6, and 7 are fragmentary, plan views of carrier stock according to alternative embodiments contemplated by this invention, each in a flat, unstressed condition.

In an alternative configuration shown fragmentarily in FIG. 4, such tear-open tabs 50 are not used. Rather, along the central region 52 of each outer segment 34, the inner edge 56 thereof has a central portion 70, which is convex when the carrier stock 30 is in a flat, unstressed condition. Substantially along its entire length, therefore, each outer segment 34 has a substantially uniform width when the carrier stock 30 is in a flat, unstressed condition.

Figure 5:
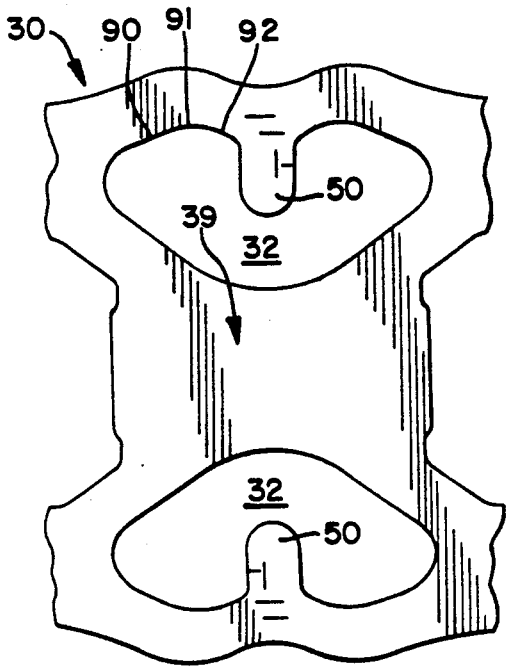

In another alternative configuration shown in FIG. 5, the transverse web section 39 is solid and does not include additional apertures 46.

Figure 6:
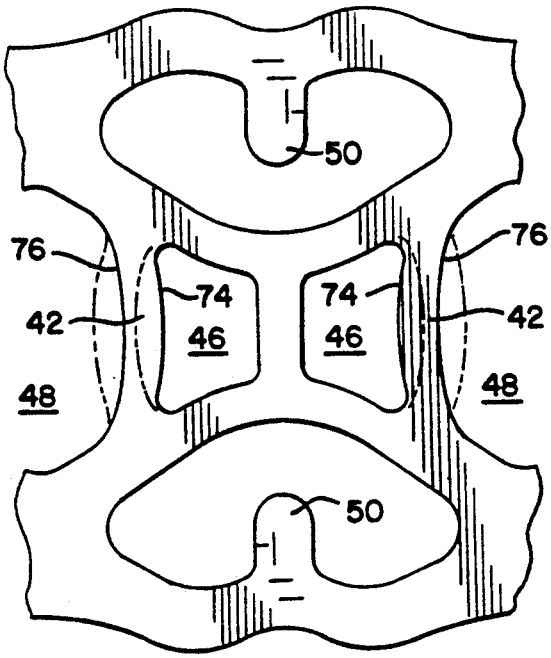

In another alternative configuration shown in FIG. 6, the generally transverse segments 42 near the ends of the can-receiving apertures 32 have curved edges 74 partly bounding the additional apertures 46 within the clusters and curved edges 76 partly bounding the additional apertures 48 between the clusters. As shown in FIG. 6, the curved edges 74, 76, of each such segment 42 of a given cluster may be concave or convex. These configurations provide a variety of handling options without compromising the integrity of the package.

Figure 7:
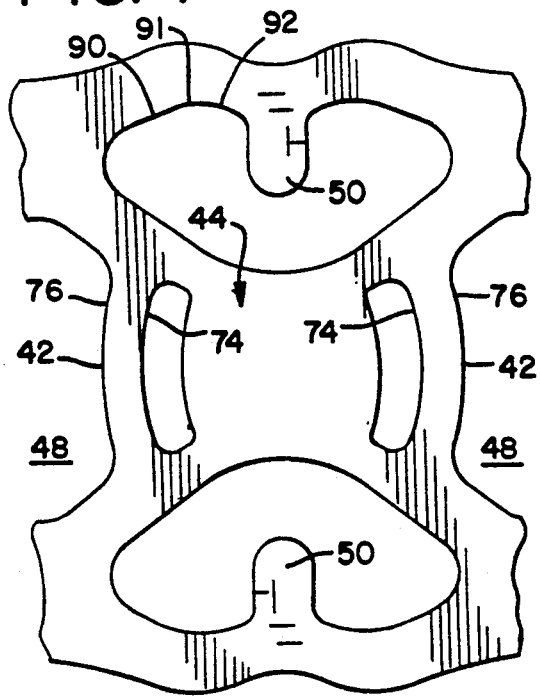

FIG. 7 shows another alternative embodiment in which the intermediate, transverse segment 44 of each cluster is greater in longitudinal dimension relative to the outer, transverse segments 42 of such cluster.

If the carrier stock 30 has the generally preferred configuration shown in FIG. 3 or any of the alternative configurations shown in FIGS. 5, 6, and 7, the carrier stock 30 can be effectively applied to cans of the newer type, such as the cans 12 shown in FIGS. 1 and 2. Thus, as shown in FIGS. 1 and 2, the inner segments 40 and the outer segments 34 grip the frusto-conical walls 20 of the cans 12 tightly and engage the lower edges of the chimes 16. Furthermore, although the tear-open tabs 50 extend upwardly across the chimes 16, the inner segments 40 and at least regions 90 of the outer segments 34 do not tend to slide up section 20 and over chimes 16.

If the carrier stock 30 has the alternative configuration shown in FIG. 4, the carrier stock 30 can be similarly applied to cans of the newer type, such as the cans 12. Here again, although the central portions 70 of the inner edges 56 of the outer segments 34 extend upwardly across the chimes 16, the inner segments 40 and at least the regions 90 of the outer segments 34 do not tend to slide up section 20 and over chimes 16.

The obtuse angles between the central regions 52, at the inner edges 56, and the regions 92 permit the regions 90 to reliably lock beneath the chimes, as opposed to the tendencies of substantial portions of the inner edges of the outer band segments to slide over the chimes in prior art configurations.

Various modifications may be made to any of the aforenoted embodiments without departing from the scope and spirit of this invention.

I claim:

1. Carrier stock for machine application to substantially identical cans of a type having an end with a chime of a given diameter, a cylindrical side wall of a larger diameter, and a generally frustoconical wall between the cylindrical side wall and the chime, said stock being formed from a single sheet of resilient polymeric material and having integrally joined band segments defining elongated can-receiving apertures in longitudinal rows and in transverse ranks, said band segments including generally longitudinal inner band segments and generally longitudinally outer band segments joined at extremity regions, each outer band segment having a central region and having an inner edge with two lateral portions adjacent the central region where such outer segment partly bounds one of the can-receiving apertures, the lateral portions being concave when said stock is in a flat, unstressed condition, the lateral portions defining outer and inner regions, the outer regions extending from the extremity regions and directed laterally outwardly and toward the central region, the inner regions extending from the central region and directed laterally outwardly and toward the extremity regions.

2. The carrier stock of claim 1 wherein each outer segment has an outer edge with a central portion along the central region of said outer segment and with two lateral portions adjacent the central portion and wherein the lateral portions of the outer edge are convex when said stock is in a flat, unstressed condition.

3. The carrier stock of claim 2 wherein the central portion of the outer edge is concave when said stock is in a flat, unstressed condition.

4. The carrier stock of claim 2 wherein each outer segment has a substantially uniform width along the lateral portions of the inner and outer edges of said outer segment when said stock is in a flat, unstressed condition.

5. The carrier stock of claim 4 wherein the central region has an inner edge, which is convex when said stock is in a flat, unstressed condition.

6. The carrier stock of claim 5 wherein each outer segment has a substantially uniform width also along the central region when said stock is in a flat, unstressed condition.

7. The carrier stock of claim 4 wherein each outer segment has a tear-open tab joined integrally to the central region of said outer segment.

8. The carrier stock of claim 7 wherein the tear-open tabs extend into the can-receiving apertures when said stock is in a flat, unstressed condition, each tear-open tab having two parallel, lateral edges, each lateral edge merging with one of the lateral portions of the inner edge of the outer segment having said tear-open tab at a curved transition to avoid stress concentration.

9. Carrier stock for machine application to substantially identical cans of a type having an end with a chime of a given diameter, a cylindrical side wall of a larger-diameter, and a generally frusto-conical wall between the cylindrical side wall and the chime, said stock being formed from a single sheet of resilient polymeric material and having integrally joined band segments defining can-receiving apertures in longitudinal rows and in transverse ranks, said band segments including generally longitudinal inner band segments and generally longitudinal outer segments joined at extremity regions, each outer band segment having a central region and having an inner edge with two lateral portions adjacent the central region where said outer segment partly bounds one of the can-receiving apertures, the lateral portions being concave when said stock is in a flat, unstressed condition, wherein each outer segment has an outer edge with a central portion along the central region of said outer segment and with two lateral portions adjacent the central portion and wherein the lateral portions of the outer edge are convex when said stock is in a flat, unstressed condition, wherein each outer segment has a substantially uniform width along the lateral portions of the inner and outer edges of said outer segment when said stock is in a flat, unstressed condition, the lateral portions defining outer and inner regions, the outer regions extending from the extremity regions and directed laterally outward and toward the central regions, the inner regions extending from the central regions and directed laterally outwardly and toward the extremity regions, wherein each outer segment has a tear-tab joined integrally to the central region of said outer segment, wherein the tear-open tabs extend into the can-receiving apertures when said stock is in a flat, unstressed condition, each tear-tab having two parallel, lateral edges, wherein each lateral edge of each tear-open tab merges with one of the lateral portions of the inner edge of the outer segment having said tear-open tab at a curved transition to avoid stress concentration, and wherein each lateral edge of each tear-open tab defines an obtuse angle with one of the lateral portions of the inner edge of the outer segment having said tear-open tab when said stock is in a flat, unstressed condition.

10. The carrier stock of claim 1 wherein the outer segments define outer edges of the can-receiving apertures and wherein the integrally joined band segments further include generally longitudinal inner segments defining inner edges of the can-receiving apertures and generally transverse segments joining the inner aperture-defining segments, the generally transverse segments including some having curved edges when said stock is in a flat, unstressed condition.

* * * * *